United States Patent [19]

Wilson

[11] 4,138,972

[45] Feb. 13, 1979

[54] FUEL INJECTION MEANS FOR INTERNAL COMBUSTION ENGINES

[76] Inventor: Ora E. Wilson, 3906 Holly Dr., West, Holiday, Fla. 33589

[21] Appl. No.: 803,598

[22] Filed: Jun. 6, 1977

[51] Int. Cl.[2] ..... F02B 33/10; F02M 39/00; F02M 49/02

[52] U.S. Cl. ..... 123/71 R; 123/137 AC; 123/139 AJ; 123/139 AK; 239/87; 239/92; 417/380

[58] Field of Search ..... 123/32 AE, 56 BC, 69 R, 123/70 R, 71 R, 72 R, 139 AC, 139 AJ, 139 AK; 200/179; 239/87, 92, 533.4; 92/13.4, 13.6; 417/364, 380

[56] References Cited

U.S. PATENT DOCUMENTS

| | | | |
|---|---|---|---|
| 869,253 | 10/1907 | Morrow | 123/56 BC |
| 1,260,724 | 3/1918 | Slaughter et al. | 123/139 AC |
| 1,837,620 | 12/1931 | Karl | 123/56 BC |
| 1,980,924 | 11/1934 | McDonald | 123/71 R |
| 1,988,533 | 1/1935 | Woolson | 123/139 AC |
| 2,018,159 | 10/1935 | Walker et al. | 123/32 SP |
| 2,126,270 | 8/1938 | Moore | 123/56 BC |
| 2,246,701 | 6/1941 | Steiner | 123/69 R |
| 2,278,038 | 3/1942 | Toce et al. | 123/71 R |
| 2,331,784 | 10/1943 | Keller | 123/69 R |
| 2,385,239 | 9/1945 | Unsworth | 123/139 AJ |
| 2,420,432 | 5/1947 | Kalitinsky | 123/139 AJ |
| 2,602,702 | 7/1952 | Kovach | 123/139 AJ |
| 3,662,721 | 5/1972 | Klein | 123/32 AE |

*Primary Examiner*—Charles J. Myhre
*Assistant Examiner*—David D. Reynolds
*Attorney, Agent, or Firm*—Robert Henderson

[57] ABSTRACT

The subject fuel injection means, disclosed herein with one of various types of internal combustion engines with which it may be employed, comprises a fuel pumping plunger, the pumping stroke of which is controlled by an inclined surface of a manually operable slide element. Said plunger is urged in a pumping direction by fluid pressure applied thereto from compression generated in the engine's combustion chamber and is spring biased in a non-pumping direction. A solenoid, operationally timed to the rotation of the engine's crankshaft, coacts with the pumping plunger to assure starting of the plunger's pumping stroke in proper timed relation to the compression and firing of an explosive charge in the engine's combustion chamber. In said pumping stroke, the plunger closes a fuel inlet to a related pump chamber and forces fuel from said pump chamber, past a one way check valve and into the engine's combustion chamber.

3 Claims, 4 Drawing Figures

FUEL INJECTION MEANS FOR INTERNAL COMBUSTION ENGINES

BACKGROUND AND OBJECT OF THE INVENTION

Efforts have hitherto been made to provide dependable and effective means for timed injection of measured charges of fuel into the combustion chamber of an internal combustion engine. Those efforts have led to complex, costly, and often undependable fuel injection means, to all of which counts this invention is addressed.

The principal object of this invention is the provision of fuel injection means which are simple, dependable in operation, and which can be economically manufactured and incorporated into an internal combustion engine.

While the fuel injection means of this invention are useful in various types of internal combustion engines, they are shown and described herein, for illustrative purposes, only in relation to a two cycle engine.

BRIEF DESCRIPTION OF THE DRAWING

In the accompanying drawing:

FIG. 3 being a view approximately on the irregular line 3—3 of FIG. 4, and FIG. 4 being a view approximately on the line 4—4 of FIG. 3.

DETAILED DESCRIPTION OF THE INVENTION

Figure 2:
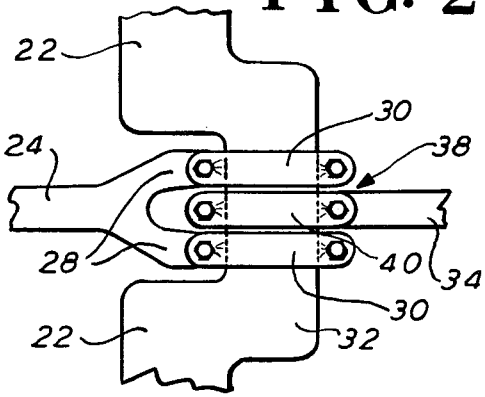
FIG. 2 is a fragmentary view as seen from the line 2—2 of FIG. 1.
Figure 1:
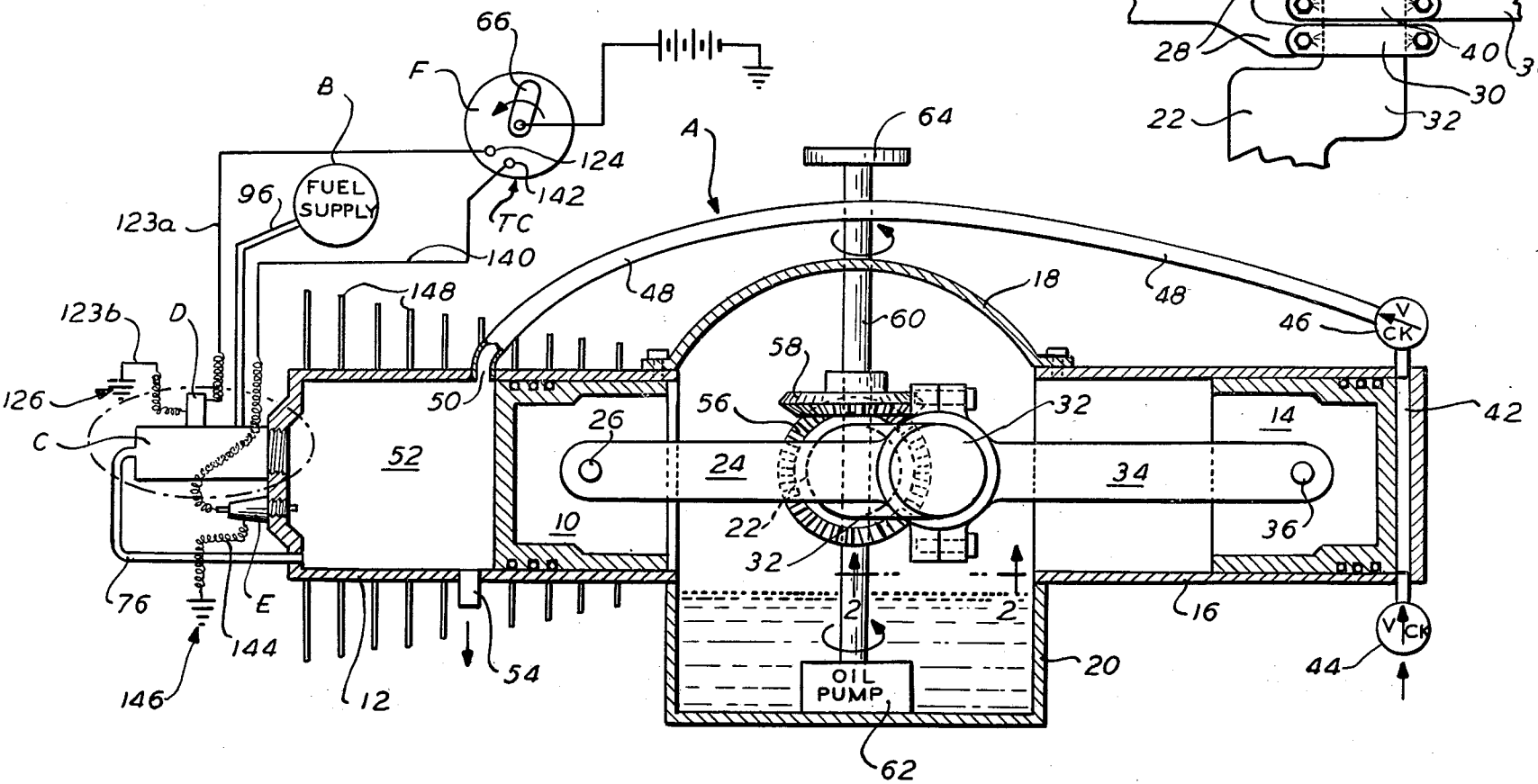
FIG. 1 is a largely schematic representation of a two cycle internal combustion engine employing fuel injection means according to a preferred embodiment of this invention, opposed cylinders and pistons therein being shown in central longitudinal section.

As disclosed, with reference particularly to FIGS. 1 and 2, the engine comprises a cylinder assembly A which includes certain working parts operating directly therewith, and certain complemental devices associated with said cylinder assembly and serving to control the operation of the engine.

The complemental devices are of the general character ordinarily employed in internal combustion engines. In the present disclosure, said complemental devices include a fuel supply B, a fuel injection device C, partially controlled by a solenoid D, a spark plug E, and a rotary switch F which distributes electrical energy, under proper timing, to said solenoid and spark plug.

THE CYLINDER ASSEMBLY

The cylinder assembly A comprises a power piston 10 arranged to reciprocate in a power cylinder 12, an air injection piston 14 arranged to reciprocate in an air injection cylinder 16, the two said cylinders being directly opposed to each other and integrally joined by a crank case 18, which includes an oil sump 20. Said cylinders are shown as disposed horizontally, but in a multi-cylinder adaptation of this invention, paired power and air injection cylinders may be disposed at various angularities relatively to horizontal.

A crank shaft 22 is supported by suitable bearings (not shown), to extend in an approximately central, horizontal position within the crank case 18. The outer end of a connecting rod 24 is pivotally connected within the piston 10 by a first pin 26, and the inner end of said connecting rod is formed with a bifurcated head 28, the two parts of which are so secured by straps 30 to a crank portion 32 of the crank shaft that said crank portion may turn freely within the connecting rod's head 28.

The outer end of a connecting rod 34 is pivotally connected within the piston 14 by a wrist pin 36, and the inner end of the connecting rod 34 is formed with a head 38 which is so secured by a strap 40 to the crank shaft's portion 32 that said crank portion may turn freely within the head 38 of the connecting rod 34. The latter's head 38 is preferably connected to the crank portion 32, between the bifurcation parts of the head 28 so that the two connecting rods 24 and 34 are operationally opposite to each other. It will readily be understood that the rod heads 28 and 38 oscillate relatively to each other during operation of the engine.

The area within the air injection cylinder 16 at the outer end of the piston 14 constitutes an air compression chamber 42 into which an air intake check valve 44 serves to uni-directionally admit ambient air only into said chamber. A second check valve, numbered 46, serves to only permit egress of air from the chamber 42 into a pipe 48 or equivalent air duct which conveys air through a port 50 and into a combustion chamber 52 constituted by an area within the power cylinder 12 at the outer end of the piston 10. An exhaust port 54, preferably located at the opposite side of the combustion chamber in relation to the port 50, and slightly nearer than the latter to the outer end of the power cylinder 12, serves to exhaust burned gases from the chamber 52. The approximate preferred relationship of said two ports, longitudinally of the cylinder 12, is indicated in the drawing.

A one-to-one ratio bevel gear assembly includes a first bevel gear member 56, fixed to the crank shaft 22 to turn therewith, and a second bevel gear member 58, intermeshing with gear member 56 and fixed to a counter shaft 60 to cause the latter to turn in equal angular relationship with said crank shaft. Schematically indicated are an oil pump 62 and a distributor 64 of which the rotary switch F is a part, both said pump and said distributor being operated by the counter shaft 60. The operation of the distributor is such that a rotary switching element 66 of the rotary switch F makes one complete turn with each complete turn of the crank shaft 22.

FUEL SUPPLY AND FIRING

Figure 4:
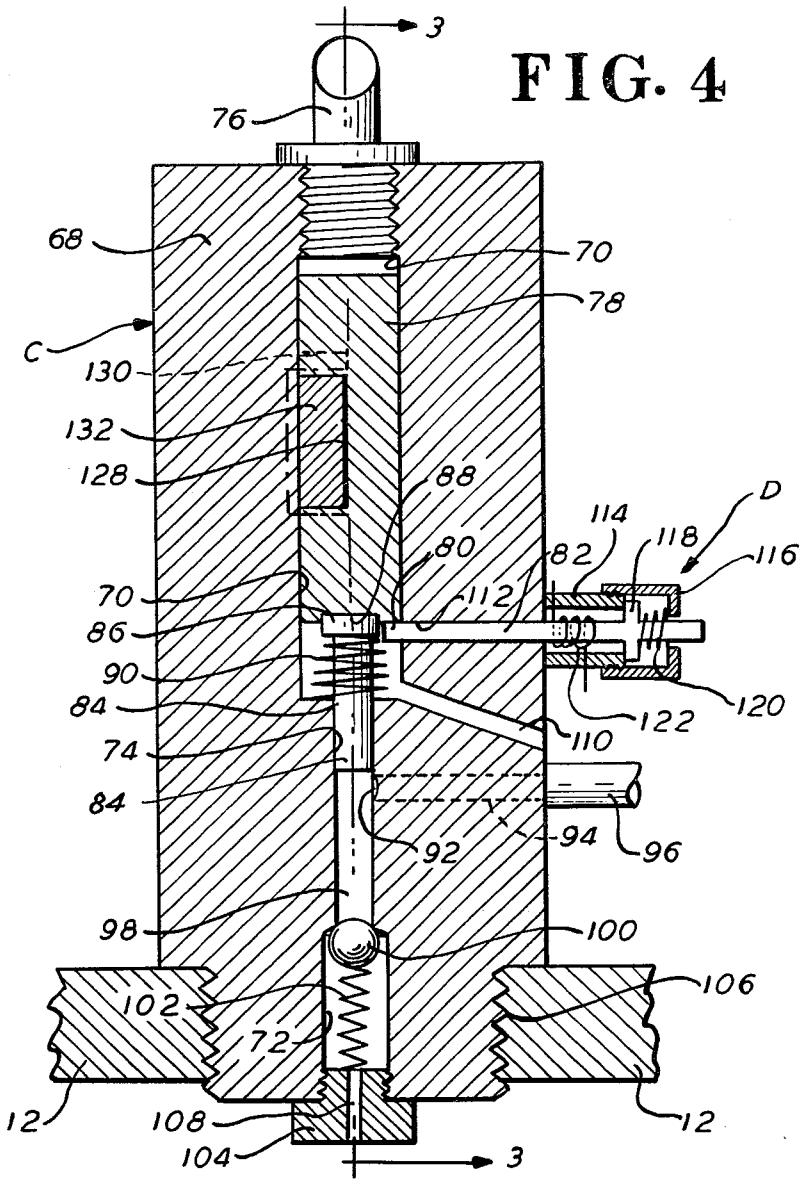
FIGS. 3 and 4 are approximately central sectional views of the fuel injection device which appears schematically within a broken line oval in FIG. 1.
Figure 3:
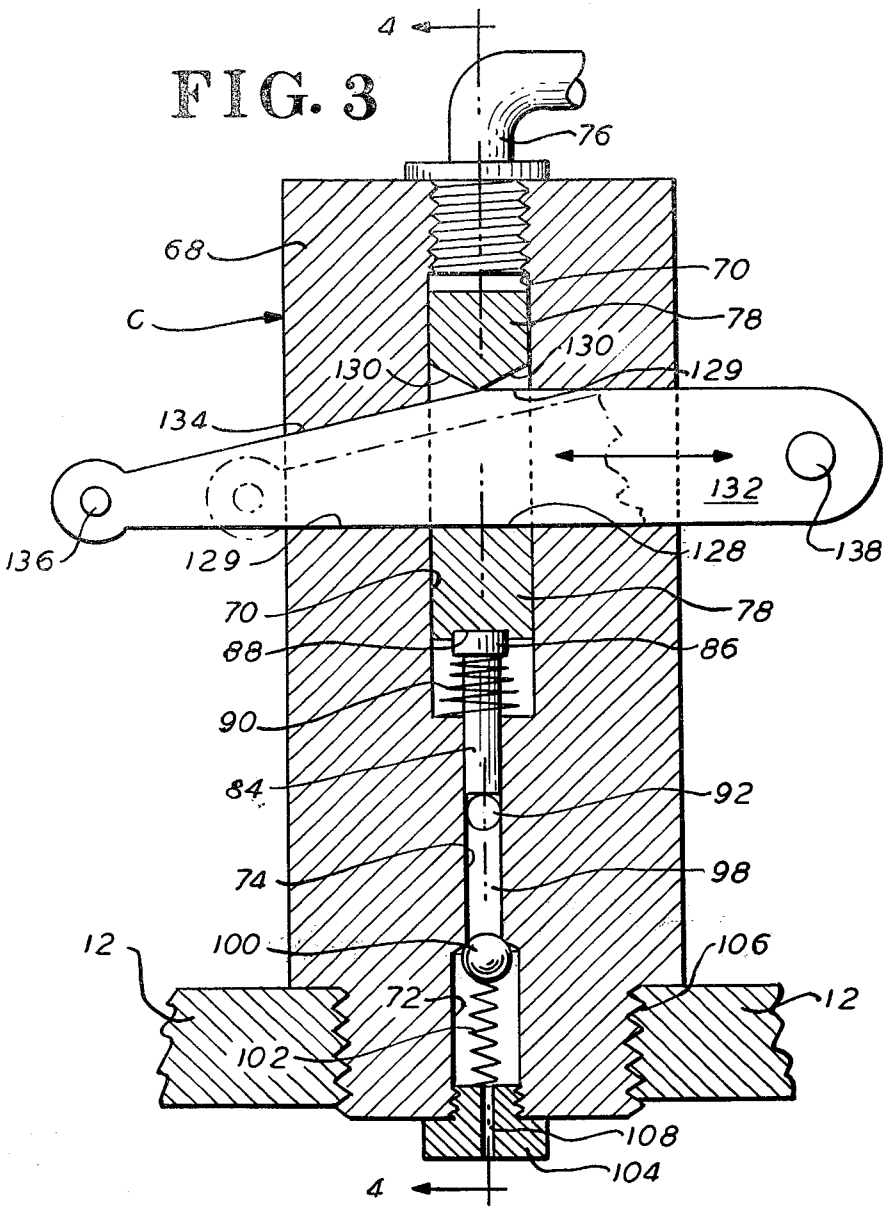

Fuel is introduced into the combustion chamber by fuel injection means, an improved form of such means being schematically indicated at C and D in FIG. 1, and illustrated in detail in FIGS. 3 and 4.

Referring particularly to FIGS. 3 and 4, the fuel pumping arrangement C,D comprises a housing 68 toward the upper end of which is formed an upper longitudinal bore 70. A somewhat narrower lower longitudinal bore 72 is formed at the lower end of the housing 68; and a still narrower counter bore 74 interconnects the bores 70 and 72.

A pipe 76, or equivalent duct (see FIG. 1), opens at one end into the combustion chamber 52 and opens at its other end into the bore 70 of the housing 68; suitable connection means being provided at the two ends of the pipe 76.

Accurately fitted and slidable within the bore 70 is a generally cylindrical plunger 78 which may be held in its uppermost position, as in FIG. 4, by the underlying inner end 80 of a rod 82 of the solenoid D. A cylindrical pumping plunger 84, of such diameter as to fit accurately and slide freely in the intermediate bore 74, has an integral, enlarged head 86 which, to aid in maintaining its centering, seats within a complemental recess 88 in the bottom of the plunger 78; and it is held seated by a helical compression spring 90 which also exerts an upward bias upon the plunger 78.

When the plungers 78 and 84 are in their uppermost positions as shown in FIG. 4, the bottom of the pumping plunger 84 is positioned at or slightly above the top of an opening 92 of a duck 94 which, in conjunction with a pipe 96, conducts fuel from the fuel supply B into a pump chamber 98 at the lower end of the bore 74.

A ball 100, of larger diameter than the pump chamber 98, is located within and at the upper end of the lower bore 72 and is yieldably urged against the lower end of the bore 74 by a compression coil spring 102 which seats at its lower end against a screw plug 104 in the bottom of the housing 68; said ball 100 thus functioning as a check valve. The housing 68 has its bottom end provided with a thread 106 by which it is threaded into the outer end of the engine's power cylinder 12. A central duct 108 in the screw plug 104 opens at one end into the bore 72 and at its other end opens into the engine's combustion chamber 52. The lower end of the upper bore 70 of the housing is vented to ambient atmosphere by a venting duct 110.

The solenoid's rod 82 is slidable and accurately fitted within a lateral bore 112 in the housing 68 and extends outwardly of said housing through a collar 114 which is suitably fixed to said housing and is provided at its outer end with an open ended screw cap 116 the open end of which has an inner diameter smaller than the inner diameter of the roller 114. The rod 82 is formed with an integral circumferential flange 118. A compressed coil spring 120, retained within the cap 116, bears against the flange 118 and serves to bias the rod 82 yieldably inwardly to its innermost position to which it is limited by engagement of the flange 118 with the outer end of the collar 114.

A wire solenoid coil 122, of suitable electrical characteristics, encircles the rod 82 and, as shown in FIG. 1, has one of its ends connected by a wire **123*a* to a fixed contact 124 of the rotary switch F, and has its other end connected by a wire 123*b* to ground at 126**.

The plunger 78 of the fuel injection device C is formed with an intermediate, transverse slideway 128, the upper area of which is beveled as at 130 to provide a line or narrow contact with the upper surface of a manually reciprocable slide element 132; a portion of said upper surface being an incline 134. The housing 68 is also formed with a slideway 129 adjoining the slideway 128 to permit the mentioned manual reciprocation of the slide element 132. The slide element is shown with holes 136, 138 in opposite ends thereof for connection of linkage members thereto (not shown) as well as spring means (also not shown) by means of which the slide 132 may be moved by the operator's hand or foot between its full line, non-fuel-feed position, and its broken line, fuel-feed position.

The spark plug E is connected by a wire 140 to a sparking system contact 142 of the rotary switch F, and is connected by wire 144 to ground 146. As the sparking system as a whole is substantially similar to sparking systems presently in common use, further details of said system are not necessary to an understanding of this invention and, for that reason, have been omitted from this disclosure.

The power cylinder 12 may be air cooled for which purpose it is provided with integral cooling fins 148; or it may be water cooled by means well known to those conversant with the subject art.

The following description of the engine presupposes that the slide element 132 has been manually set at its broken line position (FIG. 3) or between that position and its solid line position; and that the engine has been started by manual or mechanical cranking.

PISTON OPERATION IN THE ENGINE

It should first be understood that, by reason of the described interconnection of the pistons 10 and 14 at the same crank portion 32 of the crank shaft 22, said two pistons always move in the same directions and momentarily dwell simultaneously at the extremities of their strokes.

With the pistons 10 and 14 momentarily dwell-positioned as shown in FIG. 1, a charge of compressed air from air compression chamber 42 will have passed through pipe 48 and port 50 into combustion chamber 52 to provide a charge of air in the latter chamber while completing the scavenging of burned gases from chamber 52, which scavenging had shortly before been initiated through exhaust port 54. Timed injection of fuel into chamber 52 is hereinafter explained.

Continued turning of the crank shaft 22 causes piston 10 to move outwardly in cylinder 12 and piston 14 to move inwardly in cylinder 16. Such inward movement of piston 14 serves to draw air into chamber 42 through check valve 44. The piston 10, in its outward movement first sequentially closes ports 50 and 54 almost at the same moment, then compresses the air in the chamber 52 until, at or near its outermost position, fuel is injected into the latter chamber and the air-fuel mixture is fired. The firing of said mixture forces the piston 10 inwardly until, toward the end of it said inward stroke it opens ports 54 and 50 to again exhaust burned gases from chamber 52 and, as a commencement of a repeat operational cycle, to admit another charge of air into the chamber 52, through pipe 48, from the compression chamber 42.

FUEL INJECTION AND COMBUSTION

The continuously turning, rotary switching element 66 of the switch F is shown in FIG. 1 in its approximate angular position as when the pistons 10 and 14 are positioned as shown in that figure. During the build up of air pressure in combustion chamber 52, due to the outward movement of the piston 10, said switching element's counter clockwise turning brings it into engagement with solenoid contact 124, thereby energizing the solenoid D to withdraw the latter's rod 82 from underneath the plunger 78 of the fuel injection device C.

Meanwhile, the increased air pressure in the combustion chamber 52 has been communicated from the latter chamber, by pipe 76, into the upper end of bore 70 of the fuel injection device, causing the plunger 78 and its related pumping plunger 84 to move downwardly against the force of spring 90. To the extent of the downward movement permitted by the setting of slide element 132, fuel in the pump chamber 98 is pumped past ball 100 into bore 72 and thence through duct 108 into combustion chamber 52 in close proximity to the sparking electrodes of the spark plug E.

Within a few degrees after engaging the contact 124 to activate the solenoid D, the rotary switching element 66 disengages the contact 124 and engages spark plug contact 142 of the switch F to cause the spark plug E to fire the fuel-air charge in the combustion chamber 52 to cause the inward movement of the piston 10 and the outward movement of the piston 14. With the two pistons in their last stated positions, i.e., with the piston 10 in its innermost position, the pressure in the chamber 52, and hence above the plunger 78 in the fuel injection device, is low enough that said plunger rises under the impetus of the spring 90, and the solenoid rod 82 moves inwardly under the impetus of spring 120 so that said rod's end underlies the plunger 78 and will remain thereunder until the solenoid D is again energized during further operation of the engine.

Subject to some possible engineering variations, the described injection of fuel into the chamber 52 may occur about 15° before outwardly moving piston 10 reaches top (outer) dead center and the firing of the fuel-air charge may occur at or about 5° before said piston reaches top dead center. The arrow TC applied to the switch F corresponds approximately to the position of switching element 66 when the piston 10 is at top dead center.

Once the described operational cycles are established, they continue until the fuel is depleted or deliberately closed off by manual movement of the slide 132 to its full line position of FIG. 3, in which position it prevents any operation of the pumping plunger 84.

GENERAL COMMENTS

It should be apparent that, instead of employing a single power cylinder as shown herein, an engine employing this invention may have plural power cylinder, suitably arranged radially about the crankshaft and coacting therewith to provide smoother operation of the engine.

It should be well understood, also, that, through the application of known engineering principles or by experimentation, a suitable relationship of the volumes of chambers 42 and 52 may be attained by suitably modifying the diameter of the pipe 48 and/or by modifying one or the other of the cylinders 12 and 16 and their related pistons. Other variations likewise may be practiced without departing from the invention as set forth in the following claims.

I claim:

1. An internal combustion engine comprising a power cylinder, a power piston reciprocable in said cylinder, an air injection cylinder, an air injection piston reciprocable in the latter cylinder, an air duct interconnecting the two said cylinders, a crank shaft having crank means connected to both said pistons constraining said air injection piston to pursue an air compression stroke and an air intake stroke approximately simultaneously with and respectively with reference to a combustion stroke and a compression stroke of said power piston; and fuel injection means and firing means coacting with said power cylinder and timed to operate sequentially approximately at the end of said power piston's compression stroke; said air duct being so interconnected between the two said cylinders as to transfer air from said air injection cylinder into said power cylinder approximately at the end of said power piston's combustion stroke, said fuel injection means comprising a housing disposed upon the outer end of said power cylinder and formed with a bore therein opening into the latter cylinder, plunger means accurately fitted slidably in said bore, a solenoid having a solenoid rod coacting with said plunger means to hold the latter in an upper, non-fuel-injecting position, a duct interconnecting the upper end of said bore and a combustion chamber at the outer end of said power cylinder, spring means coacting with said plunger means to bias the latter toward its said upper position, a fuel controlling check valve, located in said bore at a distance below said plunger means to define therebetween a pump chamber, duct means opening into said pump chamber to transport fuel into the latter chamber, a manually operable slide element coacting with said plunger means to adjustably limit the sliding of said plunger means, a rotary switch coacting with said crankshaft and having a contact electrically connected to said solenoid, and a rotary switching element turning in one-to-one relationship to the turning of said crankshaft, said contact being so positioned in said rotary switch as to cause energizing of said solenoid to withdraw the latter's said rod from its coaction with said plunger means concurrently with the approach of said power piston to its outermost position in the power cylinder, thereby permitting said plunger means to force a measured charge of fuel from said pump chamber, past said fuel controlling check valve and into said combustion chamber.

2. An engine according to claim 1, said slide element having an inclined surface coacting with said plunger means for varying the limitation of movement of said plunger means relatively to said fuel controlling check valve, and thereby to control the volume of fuel injected into said combustion chamber from said pump chamber.

3. In an internal combustion engine comprising a power cylinder, a crankshaft, a piston reciprocable in said cylinder in coaction with said crankshaft and partially defining a combustion chamber in said cylinder, means for introducing air into said chamber, fuel injection means for introducing fuel into said chamber to combine said fuel and air into a combustible charge in said chamber, and means for firing said charge; said fuel injection means comprising a housing disposed upon the outer end of said power cylinder and formed with a bore therein opening into the latter cylinder, plunger means accurately fitted slidably in said bore, a solenoid having a solenoid rod coacting with said plunger means to hold the latter in an upper, non-fuel-injecting position, a duct interconnecting the upper end of said bore and said combustion chamber, spring means coacting with said plunger means to bias the latter toward its said upper position, a fuel controlling check valve, located in said bore at a distance below said plunger means to define therebetween a pump chamber, duct means opening into said pump chamber to transport fuel into the latter chamber, a manually operable slide element coacting with said plunger means to adjustably limit the sliding of said plunger means, a rotary switch coacting with said crankshaft and having a contact electrically connected to said solenoid, and a rotary switching element turning in one-to-one relationship to the turning of said crankshaft, said contact being so positioned in said rotary switch as to cause energizing of said solenoid to withdraw the latter's said rod from its coaction with said plunger means concurrently with the approach of said power piston to its outermost position in the power cylinder, thereby permitting said plunger means to force a measured charge of fuel from said pump chamber, past said fuel controlling check valve and into said combustion chamber.

* * * * *